US007992229B1

(12) United States Patent
Kotowski

(10) Patent No.: US 7,992,229 B1
(45) Date of Patent: Aug. 9, 2011

(54) LIGHTED URINAL SYSTEM

(76) Inventor: Marek G. Kotowski, Sarasota, FL (US)

( * ) Notice: Subject to any disclaimer, the term of this patent is extended or adjusted under 35 U.S.C. 154(b) by 427 days.

(21) Appl. No.: 12/217,792

(22) Filed: Jul. 9, 2008

(51) Int. Cl.
*A47K 11/00* (2006.01)

(52) U.S. Cl. ..... 4/144.1

(58) Field of Classification Search ..... 4/307, 321, 4/144.1, 144.3, 450–459, 420, 301, 305, 4/367, DIG. 3; 604/317, 323, 326, 247, 335, 604/350, 212; 206/366; 29/240
See application file for complete search history.

(56) References Cited

U.S. PATENT DOCUMENTS 3,623,170 A * 11/1971 Staley et al. ..... 5/695
4,059,124 A * 11/1977 Hill ..... 137/38
4,164,795 A * 8/1979 Johnson ..... 4/144.1
4,270,231 A * 6/1981 Zint ..... 4/144.1
4,422,188 A * 12/1983 Strutton et al. ..... 4/144.4
4,656,566 A * 4/1987 Kelley ..... 362/202
4,807,344 A * 2/1989 Kelson et al. ..... 29/240
4,862,573 A * 9/1989 Kelson et al. ..... 29/240
5,331,689 A * 7/1994 Haq ..... 4/144.1
5,406,651 A * 4/1995 Nogay ..... 4/144.3
5,592,699 A * 1/1997 Jensen ..... 4/144.3
5,701,612 A * 12/1997 Daneshvar ..... 4/144.3
5,797,147 A * 8/1998 Young et al. ..... 4/144.1
5,842,233 A * 12/1998 Broden ..... 4/144.1
6,021,529 A * 2/2000 Abbato ..... 4/144.1
D439,970 S * 4/2001 Fisher et al. ..... D24/121
6,212,691 B1 * 4/2001 Heberer ..... 4/144.1
6,385,796 B1 * 5/2002 Muir, Jr. ..... 4/661
6,588,024 B2 * 7/2003 Koelliker et al. ..... 4/144.1
6,602,230 B1 * 8/2003 Fisher et al. ..... 604/317
6,732,384 B2 * 5/2004 Scott ..... 4/144.3
6,968,577 B1 * 11/2005 Taft, Jr. ..... 4/144.1
D578,211 S * 10/2008 Maze et al. ..... D24/122
7,465,942 B2 * 12/2008 Holden ..... 250/455.11
2004/0226578 A1 * 11/2004 Guest et al. ..... 134/10
2006/0213792 A1 * 9/2006 Nguyen et al. ..... 206/349
2007/0015285 A1 * 1/2007 Catt et al. ..... 436/65
2007/0225668 A1 * 9/2007 Otto ..... 604/347
2008/0223810 A1 * 9/2008 Garcia ..... 215/201
2009/0287170 A1 * 11/2009 Otto ..... 604/318

* cited by examiner

*Primary Examiner* — Lori Baker

(57) ABSTRACT

A urinal has a primary body portion defining a primary chamber and a secondary body portion integrally formed with the primary body portion defining a secondary chamber with a free upper end. A handle has an open interior end and a closed exterior end defining a tertiary chamber. An electrical assembly is coupled with respect to the urinal and includes a battery, a switch, and a light source with appropriate wiring to provide light to guide a user in directing a stream of urine into the urinal and thereby abate accidental wetting of unintended regions while urinating in the dark.

5 Claims, 3 Drawing Sheets

FIG 1
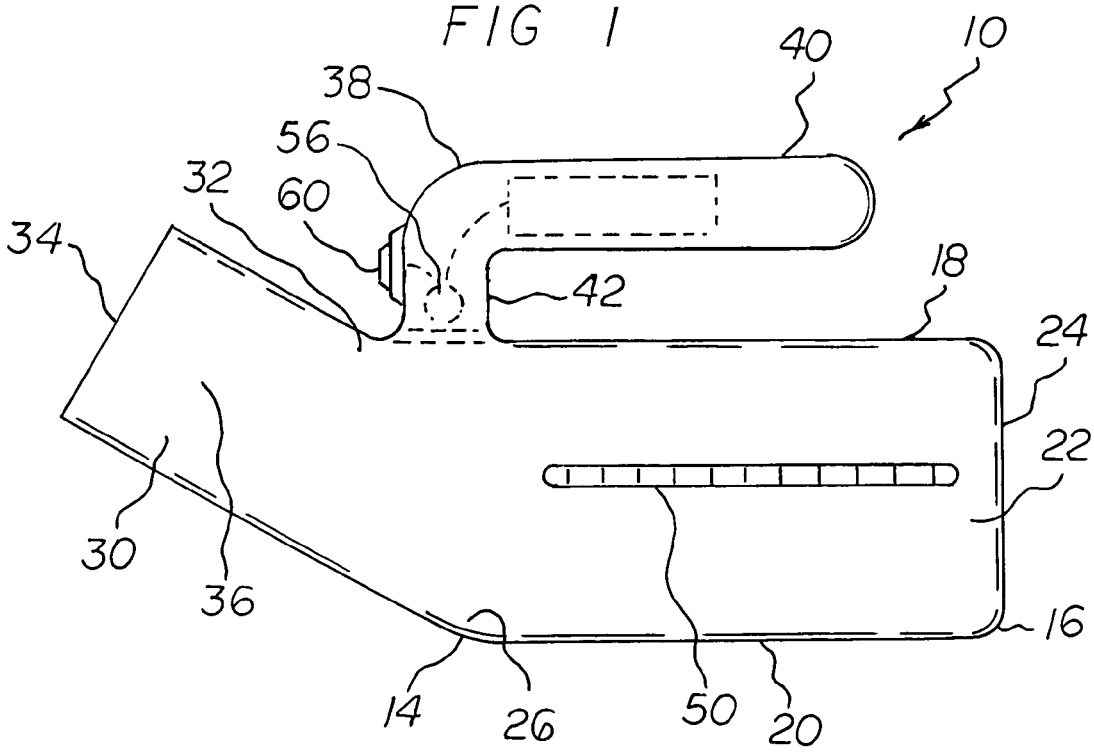
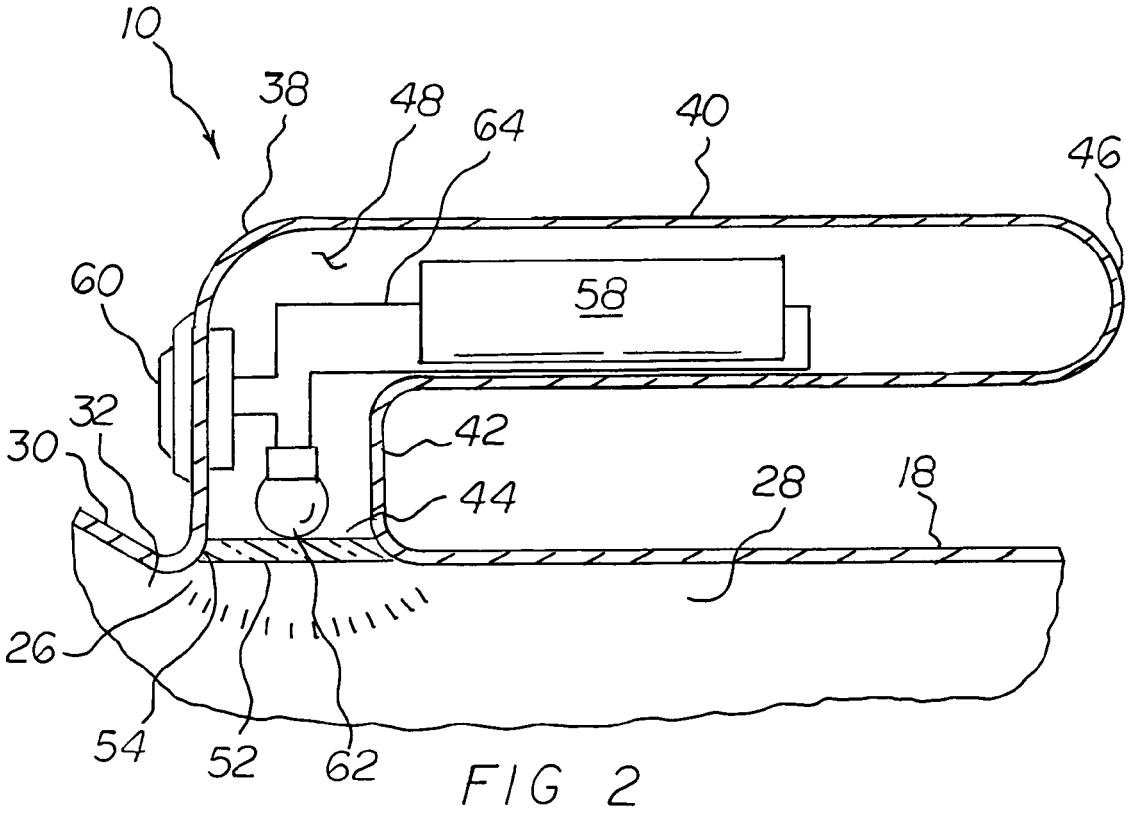
FIG 2

FIG 3
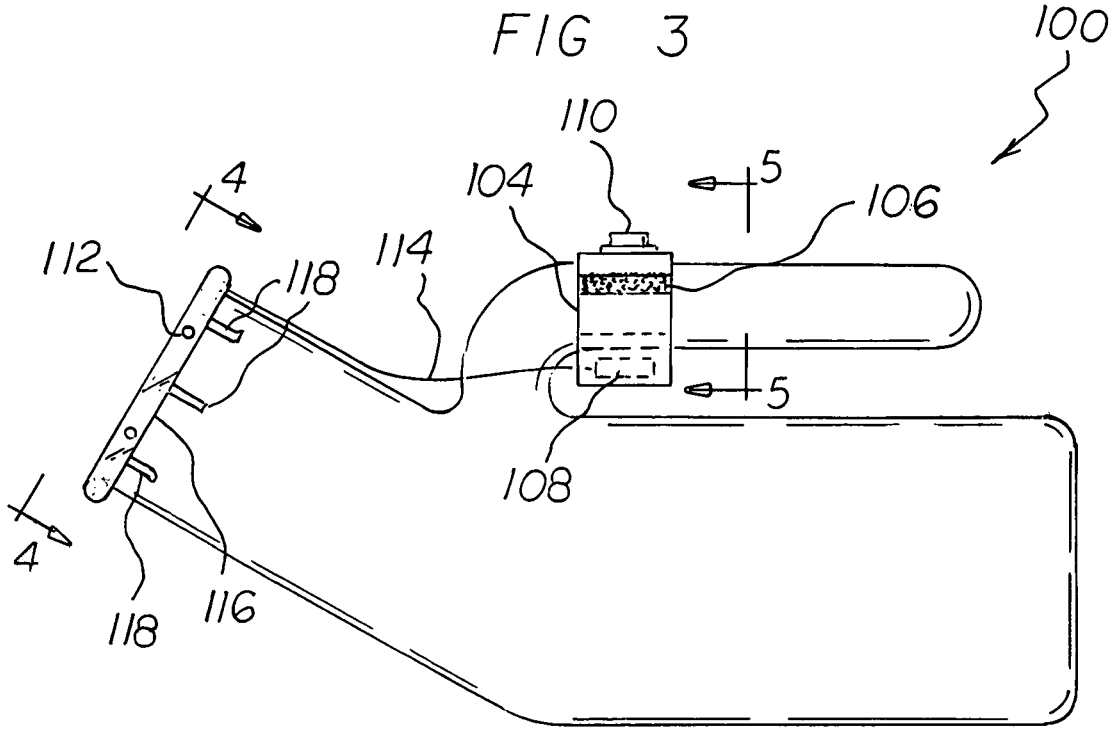
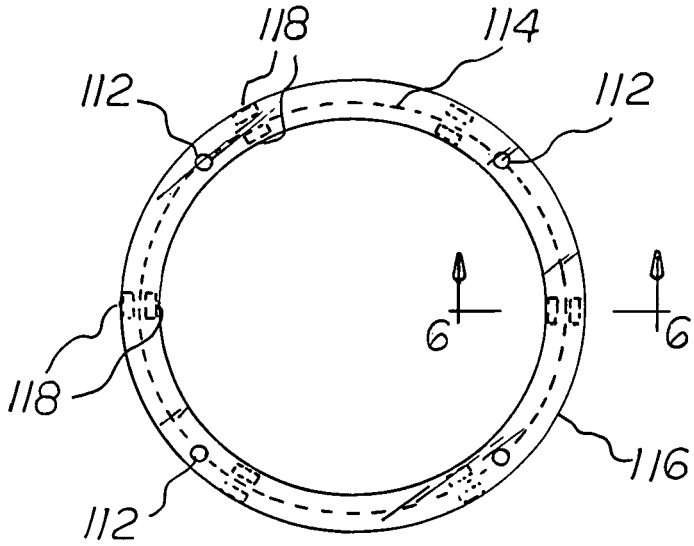
FIG 4

FIG 5
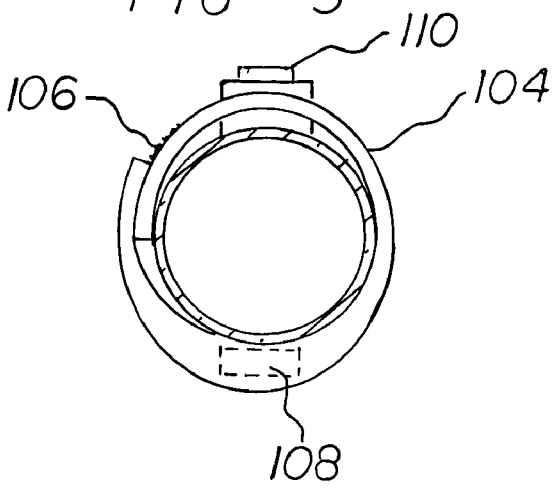
FIG 6
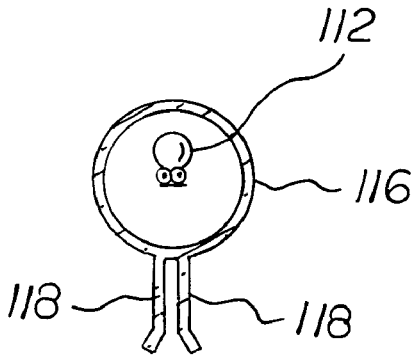
FIG 7
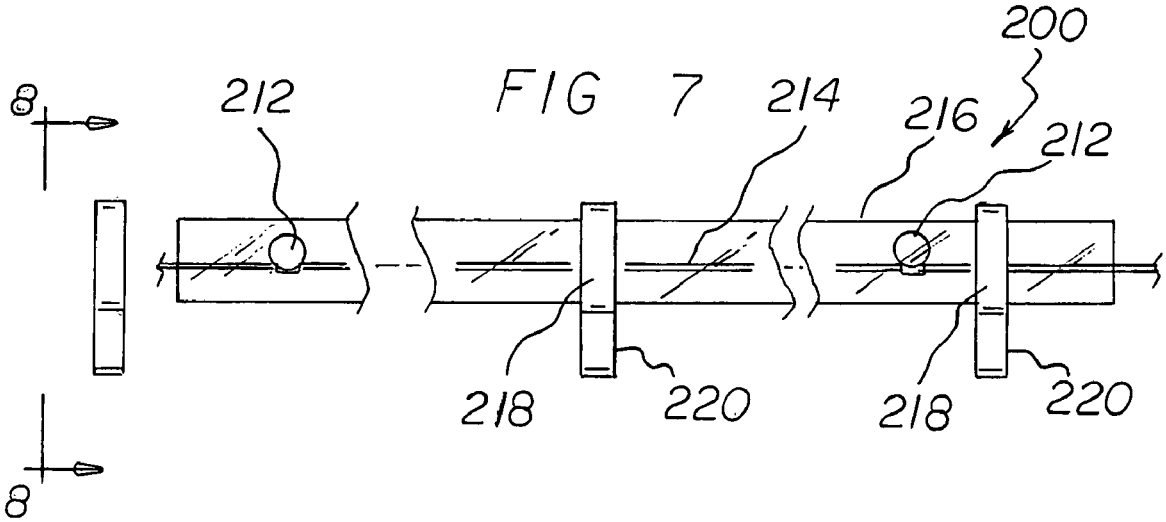
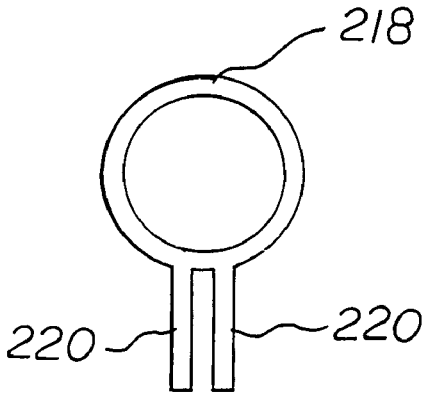
FIG 8

LIGHTED URINAL SYSTEM

BACKGROUND OF THE INVENTION

1. Field of the Invention

The present invention relates to a lighted urinal system and more particularly pertains to allowing the proper positioning of a mouth of a urinal with respect to a user in order to abate accidental wetting of unintended regions while urinating in the dark, all in a safe, convenient and economical manner.

2. Description of the Prior Art

The use of urinals of known designs and configurations is known in the prior art. More specifically, urinals of known designs and configurations previously devised and utilized for the purpose of allowing proper positioning of a urinal in the dark are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,623,170 issued Nov. 30, 1971 to Staley relates to a Mattress with Service Plug and Provision for Long Sheet. U.S. Pat. No. 6,021,529 issued Feb. 8, 2000 to Abbato relates to a Portable Male Urinal. Lastly, U.S. Pat. No. 6,385,796 issued May 14, 2002 to Muir relates to a Self Flushing Urinal with Integrated Gaming and Reward System.

While these devices fulfill their respective, particular objectives and requirements, the aforementioned patents do not describe a lighted urinal system that allows the proper positioning of a mouth of a urinal with respect to a user in order to abate accidental wetting of unintended regions while urinating in the dark, all in a safe, convenient and economical manner.

In this respect, the lighted urinal system according to the present invention substantially departs from the conventional concepts and designs of the prior art, and in doing so provides an apparatus primarily developed for the purpose of allowing the proper positioning of a mouth of a urinal with respect to a user in order to abate accidental wetting of unintended regions while urinating in the dark, all in a safe, convenient and economical manner.

Therefore, it can be appreciated that there exists a continuing need for a new and improved lighted urinal system which can be used for the proper positioning of a mouth of a urinal with respect to a user in order to abate accidental wetting of unintended regions while urinating in the dark, all in a safe, convenient and economical manner. In this regard, the present invention substantially fulfills this need.

SUMMARY OF THE INVENTION

In view of the foregoing disadvantages inherent in the known types of urinals of known designs and configurations now present in the prior art, the present invention provides an improved lighted urinal system. As such, the general purpose of the present invention, which will be described subsequently in greater detail, is to provide a new and improved lighted urinal system and method which has all the advantages of the prior art and none of the disadvantages.

To attain this, the present invention essentially comprises a urinal with a primary body portion with a cross section in a generally rectangular configuration. The primary body portion has a vertical axis with an upper planar surface and a lower planar surface with planar side surfaces. The primary body portion also has a planar closed end and an open end. A primary chamber is defined between the closed and open ends.

The urinal has a secondary body portion with a cross section in a generally circular configuration. The secondary body portion has a linear axis extending upwardly from the vertical axis at an angle of about 30 degrees. The secondary body portion has a lower end integrally formed with the open end of the primary body portion and a free upper end. A secondary chamber is defined between the upper and lower ends.

Next provided is a handle. The handle is in a generally L-shaped configuration. The handle has a long section 40 adapted to function as a grip parallel with the vertical axis. The handle also has a short section coupling the long section to the upper planar surface of the main body portion adjacent to the secondary body portion. The handle has an open interior end and a closed exterior end. A tertiary chamber is defined between the interior and exterior ends. The primary and secondary body portions and the handle are molded of an elastomeric material with a translucent viewing strip in a side wall parallel with the upper and lower planar surfaces.

Next provided is a spacer plate. The spacer plate has a circular periphery and an adhesive attaching the periphery to the short handle section adjacent to the primary body portion to thereby fluidly separate the primary and tertiary chambers. The spacer plate is fabricated of a transparent material.

Lastly, an electrical assembly is provided. The electrical assembly is coupled with respect to the handle. The electrical assembly includes a battery in the long portion of the handle for providing a source of electrical potential to the electrical assembly. The electrical assembly also includes a push button switch extending through the short portion of the handle facing the secondary body portion for activating and inactivating the electrical assembly. The electrical assembly also includes a light bulb with appropriate wiring within the secondary chamber. The light bulb is positioned adjacent to the spacer plate for selectively illuminating the primary, secondary and tertiary chambers as well as the free upper end of the secondary body portion to thereby provide light to guide a user in directing a stream of urine into the urinal and thereby abate accidental wetting of unintended regions while urinating in the dark.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lighted urinal system which has all of the advantages of the prior art urinals of known designs and configurations and none of the disadvantages.

It is another object of the present invention to provide a new and improved lighted urinal system which may be easily and efficiently manufactured and marketed.

It is further object of the present invention to provide a new and improved lighted urinal system which is of durable and reliable constructions.

An even further object of the present invention is to provide a new and improved lighted urinal system which is susceptible of a low cost of manufacture with regard to both materials and labor, and which accordingly is then susceptible of low prices of sale to the consuming public, thereby making such lighted urinal system economically available to the buying public.

Even still another object of the present invention is to provide a lighted urinal system for allowing the proper positioning of a mouth of a urinal with respect to a user in order to abate accidental wetting of unintended regions while urinating in the dark, all in a safe, convenient and economical manner.

Lastly, it is an object of the present invention to provide a new and improved lighted urinal system having a urinal with a primary body portion defining a primary chamber and a secondary body portion integrally formed with the primary body portion defining a secondary chamber with a free upper end. A handle has an open interior end and a closed exterior end defining a tertiary chamber. An electrical assembly is coupled with respect to the urinal and includes a battery, a switch, and a light source with appropriate wiring to provide light to guide a user in directing a stream of urine into the urinal and thereby abate accidental wetting of unintended regions while urinating in the dark.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an illuminated urinal system constructed in accordance with the principles of the present invention.

FIG. 2 is an enlarged cross sectional showing of the upper portion of the system illustrated in FIG. 1.

FIG. 3 is a side elevational view of an illuminated urinal system constructed in accordance with an alternate embodiment of the present invention.

FIG. 4 is an enlarged end elevational view of taken along line 4-4 of FIG. 3.

FIG. 5 is an enlarged cross sectional view of taken along line 5-5 of FIG. 3.

FIG. 6 is an enlarged cross sectional view of taken along line 6-6 of FIG. 4.

FIG. 7 is a plan view of a further embodiment similar to the embodiment of FIGS. 4 through 6.

FIG. 8 is an enlarged end elevational view of taken along line 8-8 of FIG. 7.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved lighted urinal system embodying the principles and concepts of the present invention and generally designated by the reference numeral 10 will be described.

The present invention, the lighted urinal system 10 is comprised of a plurality of components. Such components in their broadest context include a urinal, a handle, and an electrical assembly. Such components are individually configured and correlated with respect to each other so as to attain the desired objective.

The illuminated urinal system 10 allows the proper positioning of a mouth of a urinal with respect to a user in order to abate accidental wetting of unintended regions while urinating in the dark, all in a safe, convenient and economical manner.

First provided is a urinal 14. The urinal has a primary body portion 16 with a cross section in a generally rectangular configuration. The primary body portion has a vertical axis with an upper planar surface 18 and a lower planar surface 20 with planar side surfaces 22. The primary body portion also has a planar closed end 24 and an open end 26. A primary chamber 28 is defined between the closed and open ends.

The urinal has a secondary body portion 30 with a cross section in a generally circular configuration. The secondary body portion has a linear axis extending upwardly from the vertical axis at an angle of about 30 degrees. The secondary body portion has a lower end 32 integrally formed with the open end of the primary body portion and a free upper end 34. A secondary chamber 36 is defined between the upper and lower ends.

Next provided is a handle 38. The handle is in a generally L-shaped configuration. The handle has a long section 40 adapted to function as a grip parallel with the vertical axis. The handle also has a short section 42 coupling the long section to the upper planar surface of the main body portion adjacent to the secondary body portion. The handle has an open interior end 44 and a closed exterior end 46. A tertiary chamber 48 is defined between the interior and exterior ends. The primary and secondary body portions and the handle are molded of an elastomeric material with a translucent viewing strip 50 in a side wall parallel with the upper and lower planar surfaces.

Next provided is a spacer plate 52. The spacer plate has a circular periphery and an adhesive 54 attaching the periphery to the short handle section adjacent to the primary body portion to thereby fluidly separate the primary and tertiary chambers. The spacer plate is fabricated of a transparent material.

Lastly, an electrical assembly 56 is provided. The electrical assembly is coupled with respect to the handle. The electrical assembly includes a battery 58 in the long portion of the handle for providing a source of electrical potential to the electrical assembly. The electrical assembly also includes a push button switch 60 extending through the short portion of the handle facing the secondary body portion for activating and inactivating the electrical assembly. The electrical assembly also includes a light bulb 62 with appropriate wiring 64 within the secondary chamber. The light bulb is positioned adjacent to the spacer plate for selectively illuminating the primary, secondary and tertiary chambers as well as the free upper end of the secondary body portion to thereby provide light to guide a user in directing a stream of urine into the urinal and thereby abate accidental wetting of unintended regions while urinating in the dark.

An alternate embodiment of the invention is illustrated in FIGS. 3 through 6. In this embodiment, the system 100 includes a flexible strap 104 adapted to be wrapped around the handle with a releasable fastener 106 for coupling and uncoupling the strap with respect to the handle. The battery 108 and the switch 110 are supported by the strap and a light source 112 positioned adjacent to the free upper end of the urinal. Wiring couples the battery, switch and light source. In this embodiment, the system further includes a translucent ring 116 supporting the light source. Resilient legs 118 removably couple the ring and light source to the free upper end.

An additional alternate embodiment of the invention is illustrated in FIGS. 7 and 8. In this embodiment, the system 200 further includes a translucent flexible strap 216 supporting the light source 212 and a portion of the wiring 214. Rigid rings 218 support the translucent flexible strap. Resilient legs 220 removably couple the ring and light source to the free upper end. The other components of this additional alternate embodiment are essentially the same as in the alternate embodiment of FIGS. 3 through 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated urinal system comprising:

a urinal having a primary body portion defining a primary chamber and a secondary body portion integrally formed with the primary body portion defining a secondary chamber with a free upper end;

a handle having an open interior end and a closed exterior end defining a tertiary chamber; and an electrical assembly coupled with respect to the urinal and including a battery and a switch and a light source with appropriate wiring to provide light for selectively illuminating a chamber of the urinal in order to guide a user in directing a stream of urine into the urinal and thereby abate accidental wetting of unintended regions while urinating in the dark.

2. The system as set forth in the claim 1 and further including:

a transparent spacer plate with a periphery attached to the short handle section adjacent to the primary body portion to separate the primary and tertiary chambers; and wherein the light source is within the tertiary chamber.

3. The system as set forth in claim 1 and further including a flexible strap adapted to be wrapped around the handle with a releasable fastener for coupling and uncoupling the strap with respect to the handle, the battery and the switch being supported by the strap and the light source being positioned adjacent to the free upper end of the urinal with wiring coupling the battery, switch and light source, the system further including a translucent ring supporting the light source and with resilient legs removably coupling the ring and light source to the free upper end.

4. The system as set forth in claim 1 and further including a translucent flexible strap supporting the light source and a portion of the wiring and with rigid rings supporting the translucent flexible strap and with resilient legs removably coupling the ring and light source to the free upper end.

5. An illuminated urinal system for allowing the proper positioning of a mouth of a urinal with respect to a user in order to abate accidental wetting of unintended regions while urinating in the dark, all in a safe, convenient and economical manner, the system comprising, in combination:

a urinal having a primary body portion with a cross section in a generally rectangular configuration, the primary body portion having a vertical axis with an upper planar surface and a lower planar surface with planar side surfaces, the primary body portion having a planar closed end and an open end defining a primary chamber between the closed and open ends;

the urinal having a secondary body portion with a cross section in a generally circular configuration, the secondary body portion having a linear axis extending upwardly from the vertical axis at an angle of about 30 degrees, the secondary body portion having a lower end integrally formed with the open end of the primary body portion and a free upper end defining a secondary chamber between the upper and lower ends;

a handle in a generally L-shaped configuration with a long section adapted to function as a grip parallel with the vertical axis and a short section coupling the long section to the upper planar surface of the main body portion adjacent to the secondary body portion, the handle having an open interior end and a closed exterior end defining a tertiary chamber between the interior and exterior ends, the primary and secondary body portions and the handle being molded of an elastomeric material with a translucent viewing strip in a side wall parallel with the upper and lower planar surfaces;

a spacer plate with a circular periphery and an adhesive attaching the periphery to the short handle section adjacent to the primary body portion, to thereby fluidly separate the primary and tertiary chambers, the spacer plate being fabricated of a transparent material; and an electrical assembly coupled with respect to the handle, the electrical assembly including a battery in the long portion of the handle for providing a source of electrical potential to the electrical assembly, and a push button switch extending through the short portion of the handle facing the secondary body portion for activating and inactivating the electrical assembly, and a light bulb with appropriate wiring within the secondary chamber positioned adjacent to the spacer plate for selectively illuminating the primary, secondary and tertiary chambers as well as the free upper end of the secondary body portion to thereby provide light to guide a user in directing a stream of urine into the urinal and thereby abate accidental wetting of unintended regions while urinating in the dark.

* * * * *